US011303033B1

(12) United States Patent
Bamford et al.

(10) Patent No.: US 11,303,033 B1
(45) Date of Patent: Apr. 12, 2022

(54) ADJUSTABLE HELICAL ANTENNA

(71) Applicant: The United States of America as represented by the Secretary of the Navy, Newport, RI (US)

(72) Inventors: David J Bamford, Wakefield, RI (US); Paul Medeiros, Middleboro, MA (US); Douglas A Sasko, West Mystic, CT (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 17/080,888

(22) Filed: Oct. 27, 2020

(51) Int. Cl.
*H01Q 1/36* (2006.01)
*H01Q 11/08* (2006.01)
*H01Q 3/12* (2006.01)

(52) U.S. Cl.
CPC ..... *H01Q 11/08* (2013.01); *H01Q 1/362* (2013.01); *H01Q 3/12* (2013.01)

(58) Field of Classification Search
CPC ..... H01Q 1/36; H01Q 1/362; H01Q 3/12; H01Q 11/08; H01Q 11/086
See application file for complete search history.

(56) References Cited

U.S. PATENT DOCUMENTS 3,737,912 A * 6/1973 Cribb ..... H01Q 1/084 343/880
5,146,235 A * 9/1992 Frese ..... H01Q 3/01 343/872
5,945,953 A * 8/1999 Tsuda ..... H01Q 1/244 343/702
6,246,379 B1 * 6/2001 Josypenko ..... H01Q 1/36 343/850
7,173,576 B2 * 2/2007 O'Neill, Jr. ..... H01Q 11/08 343/702
10,892,545 B1 * 1/2021 Parsche ..... H01Q 1/12

* cited by examiner

*Primary Examiner* — Tho G Phan
(74) *Attorney, Agent, or Firm* — James M. Kasischke; Michael P. Stanley

(57) ABSTRACT

An adjustable antenna is provided with a linear central support defining a helical axis, and first and second support disks extending radially outward from the central support. The support disks are rotatable around the central support and the second support disk is translatable along the linear central support. An antenna element is coupled to the first and second support disks to define a helical path around the central support between the first and second support disks. An adjustment component is capable of translating one of the first and second support disks along the linear central support and of rotating at least one of the support disks around the central support to change the helical pitch of the antenna element.

5 Claims, 14 Drawing Sheets

ADJUSTABLE HELICAL ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates to a helical antenna having an adjustable height and pitch.

(2) Description of the Prior Art

Helical antennas include a central axis and a conductive element helically wrapped around and separated from the central axis at a fixed radius. The conductive element typically has three turns around the central axis.

A helix is defined according to a circumference and a pitch. The circumference depends on the radius of the helix with the radius being the distance from the center axis to the helix. The pitch is defined as the height of one complete helix turn as measured parallel to the central axis.

Helical antennas having a helical circumference that is small compared to a wavelength operating in a normal mode in which the antenna acts as an omni-directional monopole. Normal mode helical antennas have a helical circumference that is significantly less than the transmitted wavelength and a pitch that is significantly less than a quarter of the transmitted wavelength.

When the dimensions of the helix are comparable to the wavelength; the helical antenna operates in the axial mode to produce radiation directed along the central axis. The directivity or antenna gain of a helical antenna operating in the axial mode is affected by the number of turns around the axis and the pitch of the helix.

SUMMARY OF THE INVENTION

The present invention provides a helical antenna with an adjustable height. When the antenna height is changed; the pitch and the number of turns changes without changing the overall diameter of the antenna. The helical antenna has a pitch that can be adjusted while preventing the antenna elements from buckling or otherwise deforming out of a helical arrangement. These pitch adjustments can change the operating characteristics of the antenna for different applications, environments, or other situations.

The antenna has a linear central support to define a helical axis. The antenna has a first support disk coupled to and extending radially from the central support. The first support disk is rotatable around the linear central support. A second support disk is couples to and extends radially outward from the central support. The second support disk is rotatable around the central support and movable along the support.

A helical path having a pitch and a radius around the linear central support is defined between the first and second support disks. The antenna has an adjustment component to translate one of the first and second support disks along the linear central support and to rotate at least one of the first and second support disks around the central support.

The antenna can include a constraint disk to constrain the antenna element in a radial direction at a location between the first and second support disks on the linear central support; to translate along the central support; and to rotate around the central support.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

DETAILED DESCRIPTION OF THE INVENTION

Figure 1:
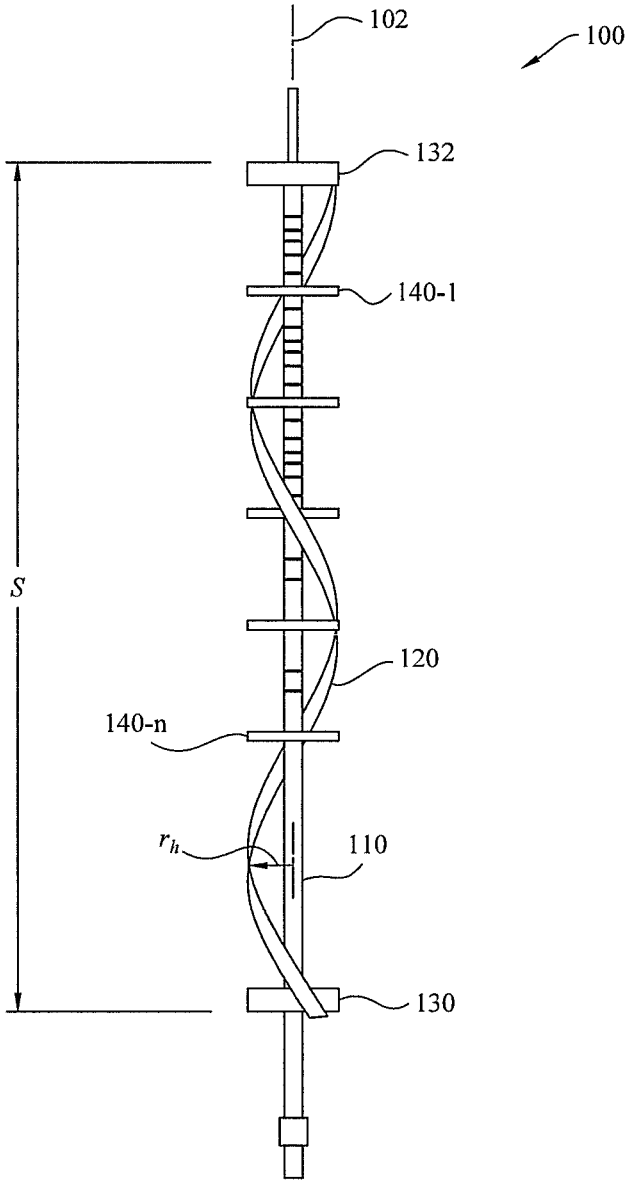
FIG. 1 depicts an adjustable monofilar helical antenna of the present invention.

The following describes an inventive assembly and system for adjustable helical antennas. FIG. 1 shows an example of an adjustable helical antenna 100. The antenna 100 includes a linear central support 110 that defines a helical axis 102. The central support 110 can be a unitary piece of material (e.g. a hollow or solid rod) having a fixed length. The central support 110 may alternatively be a telescoping rod having an adjustable length.

The antenna 100 has an antenna element 120 fixed at a first point to a support disk 130 and fixed at a second point to a support disk 132. The antenna element 120 can be fixed at or near one of the ends to the support disk 132. The antenna element 120 is fixed to the support disk 130 and may extend past the support disk. The antenna element 120 defines a helical path between the support disks 130 and 132. The helical path has a radius "$r_h$".

As shown, the antenna element 120 is a metal ribbon such as copper or other metal having a first surface and second surface. The ribbon is helically wound around the linear central support 110 such that the first surface faces radially inward toward the central support and the second surface faces radially outward from an outer circumference of the helix. The antenna element 120 may be a metal wire, or a coiled metal wire.

One or both of the support disks 130, 132 are generally annular with each of the disks having a central aperture or opening which the central support 110 passes through. One of the support disks (such as the support disk 132) is coupled to the linear central support 110. The other support disk 130 is able to move along the length of the support so that the separation between the two support disks can be changed. Alternatively, the support disk 130 may be coupled to the central support 110 such that the support disk does not translate along the length of the support while the support disk 132 translates along the length of the central support.

When the linear central support 110 is a telescoping support, both support disks 130, 132 are coupled to the linear central support 110 such that the support disks do not translate on the length of the linear central support 110. The separation between the support disks 130, 132 is changed by telescoping the central support 110.

One or both of the support disks 130, 132 is also rotatable about the helical axis 102 so that when the separation between the disks changes; the antenna element 120 can adjust to the new pitch and number of turns defined by the separation. The adjustment requires one end of the antenna element 120 to translate circumferentially about the helical axis 102.

The antenna 100 defines an adjustable separation "S" between the support disks 130, 132. As one of the support disks 130, 132 is separated or retracted with respect to the other support disk; the separation is changed and the pitch of the helix changes. The pitch of the helical path at a smaller support disk separation is smaller than the pitch of the helical path at a second larger separation. The diameter of the helix does not change because the antenna element 120 is radially constrained by constraint disks 140-1, **140-*n***.

The antenna element 120 is coupled to an area on an outer perimeter of the constraint disk 140-1. The antenna element 120 can be attached by a singular point of contact with the constraint disk 140-1.

For example, the antenna element 120 can be attached with a fastener to the constraint disk 140-1. One or more washers can be positioned between the constraint disk 140 and the antenna element 120 and between the antenna element and a head of the fastener. The antenna element 120 can rotate about the fastener to adjust the angle of the antenna element with respect to the constraint disk 140 when the pitch of the helix changes.

The material of the fastener and the washer(s) have a low coefficient of friction with respect to the antenna element 120 to reduce friction during the angular adjustments. When coupled to a constraint disk 140-1, the antenna element 120 is constrained from collapsing (or buckling) radially inward toward the linear central support 110 and from expanding radially outward at the point of coupling.

Alternatively, the antenna element 120 may not be coupled to the constraint disk 140-1 and may be able to slide circumferentially on the perimeter. When not coupled to a constraint disk, the antenna element 120 is constrained by the constraint disk from collapsing radially inward but is not constrained from radially outward movement.

Figure 2A:
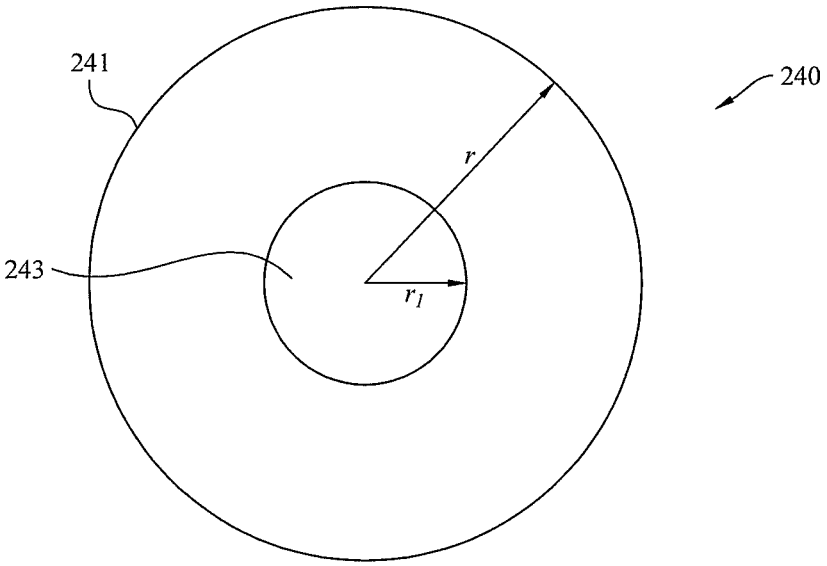
FIG. 2A depicts a first constraint disk used with the helical antenna of the present invention.

FIG. 2A depicts an annular constraint disk 240 with a radius "r" from a center to an outer perimeter 241. A central aperture or opening 243 has a smaller radius "$r_1$". The radius r defines the helical radius and thus the helical circumference. The radius $r_1$ allows the central support 110 to be inserted through the central opening 243.

Figure 2B:
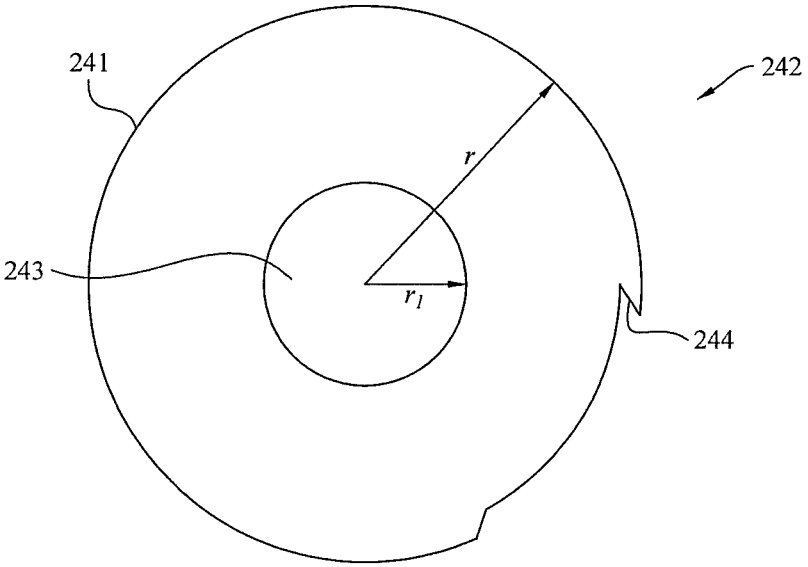
FIG. 2B depicts a second constraint disk used with the helical antenna of the present invention.

FIG. 2B depicts an annular constraint disk 242. The constraint disk 242 includes a notch 244 in the perimeter 241. The antenna element 120 can fit within the notch 244 such that a radially outward face of the antenna element 120 does not extend past the perimeter 241. The notch 244 is shaped to allow the angle of the antenna element 120 to vary within the notch from the highest to the lowest pitch operating angles of the antenna. The constraint disk 242 can include a plurality of notches 244 when a plurality of antenna elements are used.

Returning now to FIG. 1, the one or more constraint disks 140-1 thru **140-*n* are positioned between the support disks 130, 132 and along the linear central support 110. Unlike the support disks 130, 132, the constraint disks 140-1 are free to translate along the length of the linear central support 110. This free movement allows the helix defined by the antenna element 120 to elongate when the support disks 130, 132** move away from each other and to contract when the support disks move toward each other.

The constraint disks 140-1 thru **140-*n* are also capable of rotating freely about the helical axis 102, which allows the antenna element 120 to translate circumferentially as the helical pitch changes. The constraint disks 140-1 thru 140-*n*** can be made out of an electrically insulating material such as plastic, wood, ceramic, polytetrafluoroethylene (PTFE), or glass.

Figure 3A:
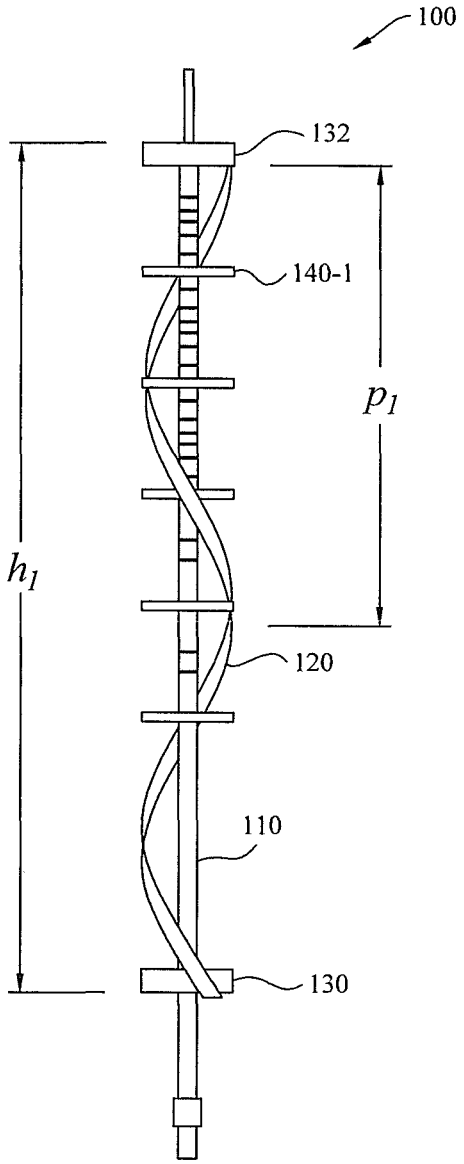
FIG. 3A depicts the adjustable helical antenna of the present invention in an extended configuration.
Figure 3B:
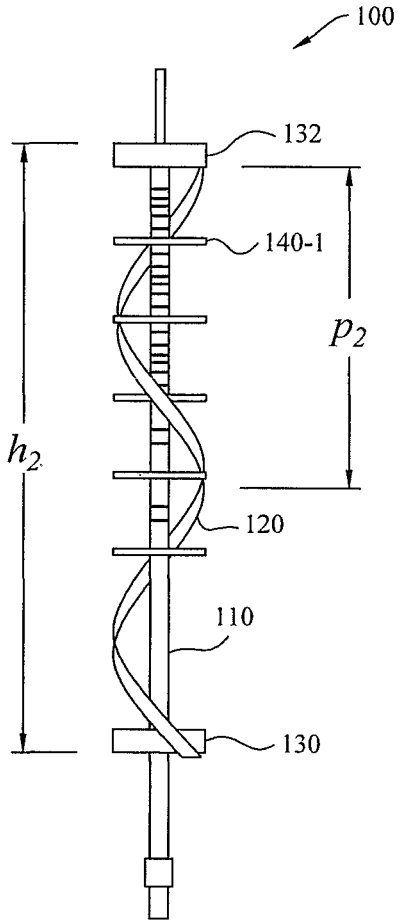
FIG. 3B depicts the adjustable helical antenna of the present invention in a retracted configuration.

In FIG. 3A, the antenna 100 is extended such that the separation between the first and second support disks has a height "$h_1$". In FIG. 3B, the antenna 100 is retracted and the separation between the first and second support disks has a height "$h_2$", which is less than $h_1$. Accordingly, the pitch of the helix defined by the antenna changes from $p_1$ in FIG. 3A to $p_2$ in FIG. 3B. The number of turns also increases from approximately one and a half turns in FIG. 3A to about two turns in FIG. 3B.

When the separation of the support disks 130, 132 changes, the height of the helix changes. This causes the distance between the constraint elements 140-1 thru **140-*n* to change as the turns in the antenna element 120 are pulled apart or pushed together. The antenna element 120 at each constraint disk 140-1 thru 140-*n***, rotates about the point where the antenna element is coupled to the constraint disk so that the angle of the antenna element relative to the constraint disk changes.

When moving from a larger separation to a smaller separation; the angle (and thus the pitch) decreases, and vice versa. The constraint disk 140-1 rotates around the helical axis 102 to cause the position of the antenna element 120 at the point where the antenna element is coupled with the constraint disk to translate circumferentially around the helical axis.

When the antenna element 120 is not coupled to the constraint disks, the antenna element can translate circumferentially relative to the constraint disk 140-1 and can slide longitudinally relative to the constraint disk during a transition from one separation to another separation.

Figure 4:
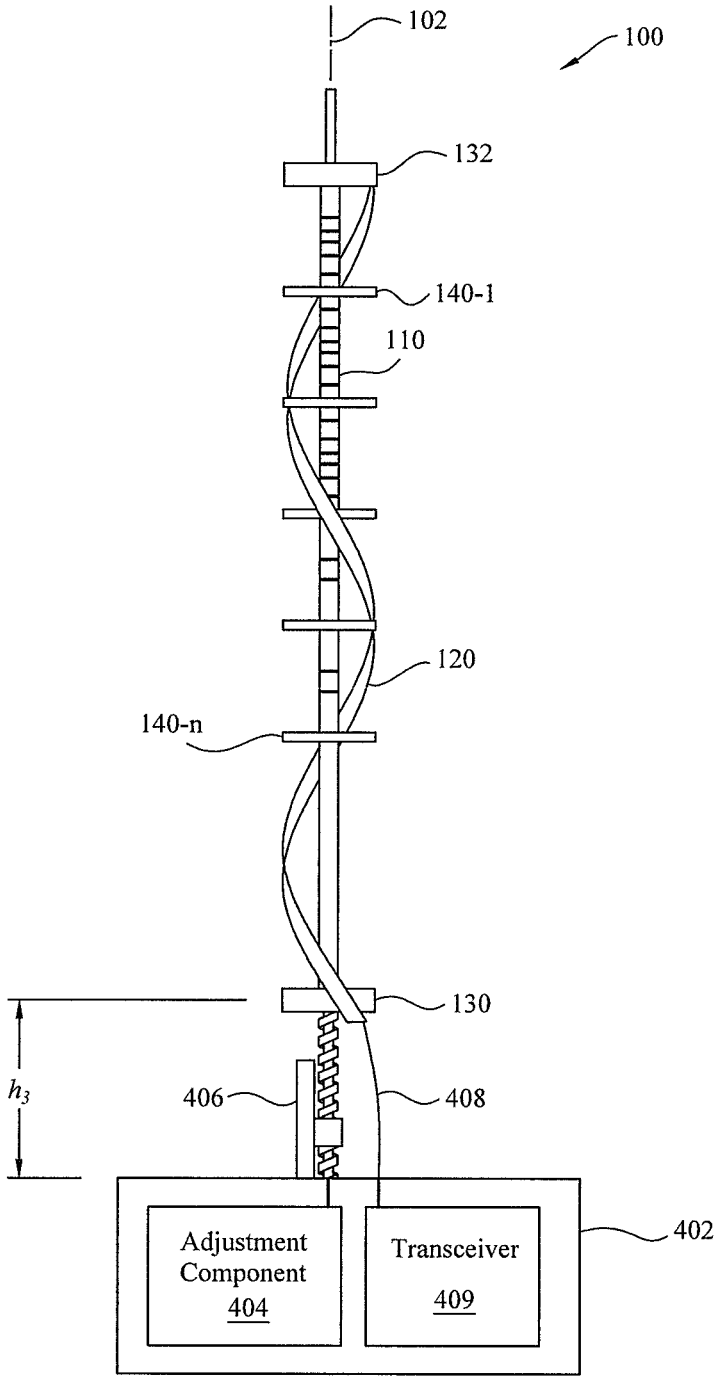
FIG. 4 depicts a system for the helical antenna with the system having a lead screw.

FIG. 4 illustrates a system having the adjustable helical antenna 100 and a base unit 402. The base unit 402 includes an adjustment component 404 in addition to other components of the antenna such as a coaxial cable feedline 408 coupling the antenna element 120 to a transceiver 409, a power supply, and a reflector ground plane or other terminator (not shown) for the lower end of the antenna.

The adjustment component 404 is capable of changing the separation between the support disks 130, 132 by raising and lowering a distal end of the linear central support 110 relative to the base 402, or by raising and lowering one of the support disks relative to the other support disk along the central support 110. The central support 110 couples to a lead screw 406 driven by a motor that rotates the lead screw to raise and lower the central support with respect to the base 402.

One of the support disks 130, 132 can be at a fixed location relative to the base unit 402 at height $h_3$, and the other support disk is capable of being raised and lowered along the helical axis relative to the fixed location. The base unit 402 can include a recess or opening to allow the central support 110 to extend into the base when the separation between the support disks 130, 132 is at or near a minimum separation.

Figure 5:
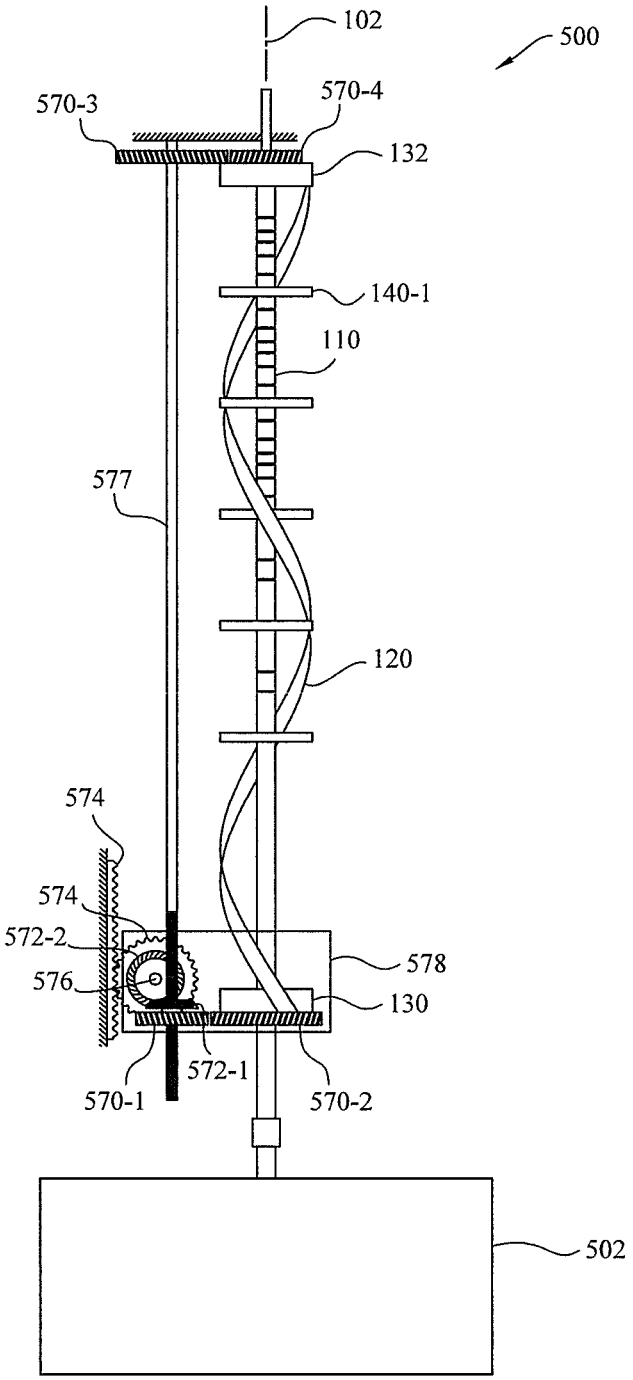
FIG. 5 depicts a system for the helical antenna with the system having a gear assembly.

FIG. 5 illustrates a system 500 comprising the adjustable antenna 100 and a base unit 502. In the system 500, rather than raising and lowering the central support 110; one of the support disks 130, 132 can be raised and lowered with respect to the other support disk. For example, a geared assembly can drive a rotation of the support disk 132. The geared assembly can also drive a rotation and an axial translation of the support disk 130.

The geared assembly includes a pair of mated helical gears 570-1 and 570-2. The helical gear 570-2 couples to the support disk 130 such that the support disk rotates with rotation of the helical gear. The helical gear 570-1 couples to a shaft 577 via a spline on the shaft. A beveled gear 572-1 is couples to the shaft 577 above the helical gear 570-1 and mates to a beveled gear 572-2 which is perpendicular to the beveled gear 572-1. The beveled gear 572-2 is coupled to a pinion gear of a rack and pinion 574 via a shaft 576. A gear box 578 contains the support disk 130, the helical gears 570, the beveled gears 572, and the pinion of the rack and pinion gear 574.

When one of the gears is driven by rotating the shaft 577, the rotation of the helical gear 570-1 causes the helical gear 570-2 to rotate in an opposite direction, which causes the support disk 130 to rotate about the linear central support 110. Simultaneously, the beveled gear 572-1 rotates with helical gear 570-1, which causes beveled gear 572-2 and the pinion gear 574 to rotate. The rotation causes the pinion to move linearly up or down the rack, which causes the gear box 578 to translate along the linear central support 110.

The geared assembly can include another pair of mated helical gears 570-3 and 570-4. The helical gear 570-4 couples to the support disk 132 such that the support disk rotates with rotation of the gear. The helical gear 570-3 is couples to the shaft 577 via a spline on the shaft. When the gear assembly is driven; the helical gear 570-3 is rotated and causes the mated helical gear 570-4 to rotate in the opposite direction; thereby, rotating the support disk 132 about the linear central support 110.

The paired helical gears 570-1 and 570-2 can have a different gear ratio than a gear ratio for the paired helical gears 570-3 and 570-4 such that the support disks 130, 132 rotate at different speeds with respect to each other. This causes one of the support disks to rotate through a larger rotation angle than the other support disk so that a helical shape is maintained as the support disk 130 is both translated and rotated.

As shown, the helical gears 570-1 and 570-3 rotate in the same direction due to the shaft 577. Alternatively, the shaft 577 may include a differential so that the helical gears 570-1 and 570-3 rotate in opposite directions. In such a configuration, the helical gears 570-4 and 570-2 and their respective coupled support disks would also rotate in opposite directions from each other. Different gear ratios can synchronize the rotational angles of the support disks with the translation of the support disk 130 towards or away from the support disk 132.

The base 502 may also house a motor and a control system for the geared assembly, in addition to other antenna components such as a power supply and a transceiver.

Figure 6:
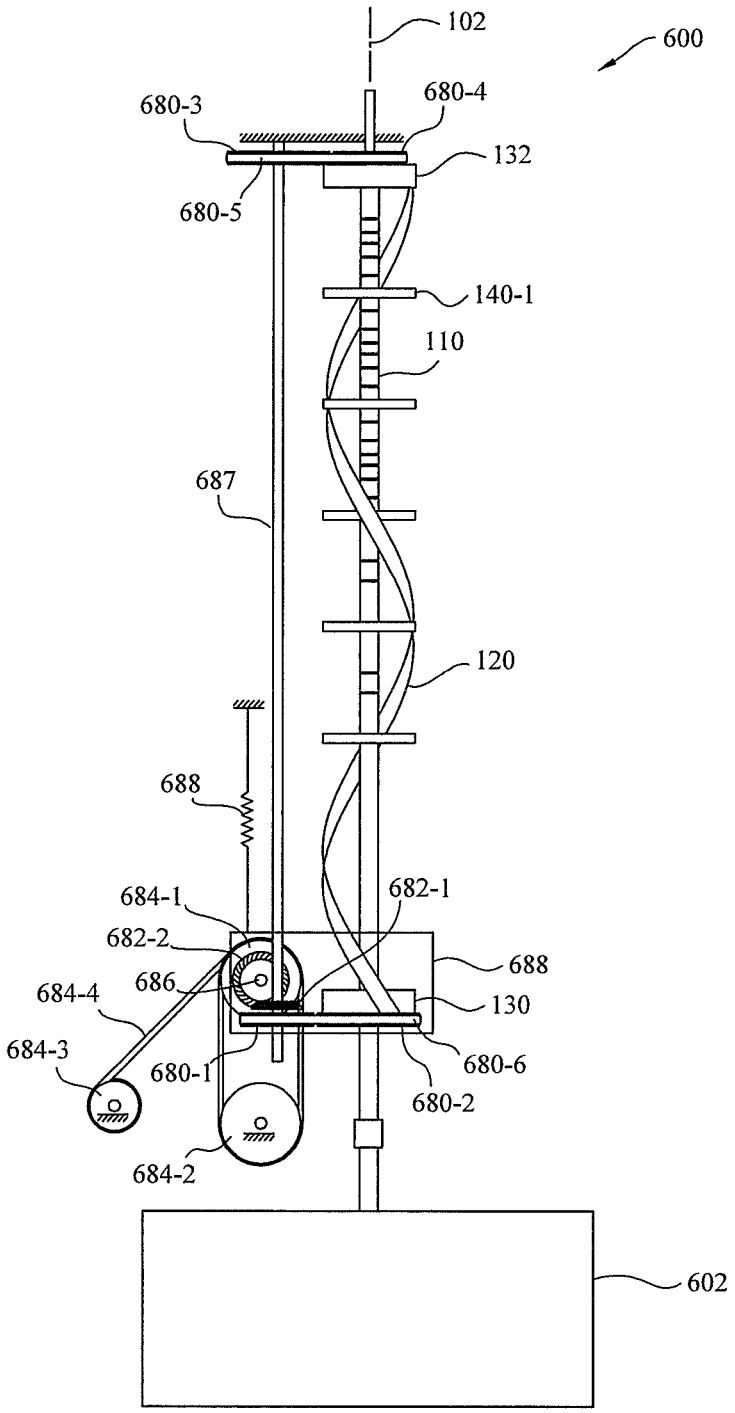
FIG. 6 depicts a system for the helical antenna with the system having a pulley assembly.

FIG. 6 illustrates a system 600 having the adjustable antenna 100 and a base unit 602. The system 600 raises and lowers one of the support disks with respect to the other support disk. The system 600 further includes a pulley assembly configured to drive a rotation of the support disk 132 and to drive a rotation and an axial translation of the support disk 130 on the linear central support 110.

For example, the pulley assembly can include a pair of pulleys 680-1 and 680-2 in which the pulleys are coupled by a belt 680-6. The pulley 680-2 couples to the support disk 130 such that the support disk rotates with the pulley. The pulley 680-1 couples to a shaft 687 via a spline and also to a beveled gear 682-1. The beveled gear 682-1 mates with a beveled gear 682-2 and couples to a shaft 686 and also to a pulley 684-1. The pulley 684-1 couples to a pulley 684-2 and to a pulley motor 684-3 via a cord 684-4. The pulley 684-2 is coupled to a fixed surface.

When the pulley motor 684-3 pulls or releases the cord 684-4; the pulley 684-1 rotates and causes the mated beveled gears 682-2 and 682-1 to rotate. The rotation of the beveled gear 682-1 in turn causes the pulley 680-1 to rotate, which causes the pulley 680-2 and the coupled support disk 130 to rotate.

The pulleys 680-1, 680-2, and 684-1 are housed inside of a gear box 678, which is coupled to a biasing member 688. When the pulley motor 684-3 pulls on the cord 684-4; the pulley 684-1 is urged toward the pulley 684-2, also translating the gear box 678 with the support disk 130 downward toward the pulley 684-2. This extends the biasing member 688. When the motor pulley 684-3 unwinds the cord 684-4; the tension on the biasing member 688 urges the gear box 678 upward to result in an upward translation of the support disk 130.

The pulley assembly can include another pair of pulleys 680-3 and 680-4 in which the pulleys are coupled by a belt 680-5. The pulley 680-4 couples to the support disk 132 such that the support disk rotates with the rotation of the gear pulley 680-4. The pulley 680-3 couples to the shaft 687 via a spline on the shaft. When the pulley assembly is driven, the pulley 680-3 rotates and causes the pulley 680-4 to rotate; thereby, rotating the support disk 132 about the linear central support 110.

Different combinations of pulleys 680 can synchronize the rotational angles of the support disks with the translation of the support disk 130 towards or away from the support disk 132 in order to maintain the helical shape of the antenna element 120.

The base 602 can also house a control system for the pulley assembly to control the motor pulley 684-3 in addition to other antenna components such as a power supply and a transceiver.

Figure 7:
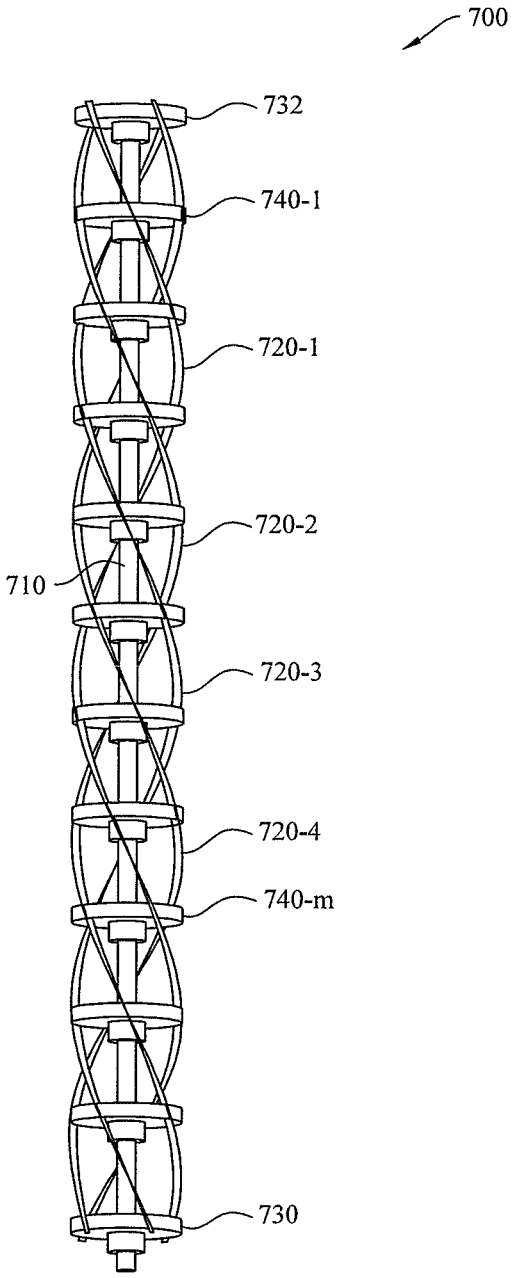
FIG. 7 depicts a first example of an adjustable helical antenna with the helical antenna having constraint disks.

The antenna 100 depicts a monofilar helical antenna. However, adjustable bifilar or quadrifilar helical antennas may also be provided. FIG. 7 illustrates an adjustable quadrifilar helical antenna 700. The antenna 700 has four antenna elements 720-1, 720-2, 720-3, and 720-4. The antenna 700 has support disks 730 and 732 with one or more constraint disks 740-1, **740-*m* positioned therebetween. The constraint disks 740-1, 740-*m* couple to each of the four antenna elements 720-1, 720-2, 720-3, and 720-4 where the coupling points between each of the respective antenna elements and a given constraint disk 740** are circumferentially spaced apart from each other.

The constraint disks 740 radially constrain the antenna elements 720-1, 720-2, 720-3, and 720-4 and are capable of translating and rotating about a linear central support 710. The antenna elements 720-1, 720-1, 720-3, and 720-4 can be metal wire.

Figure 8:
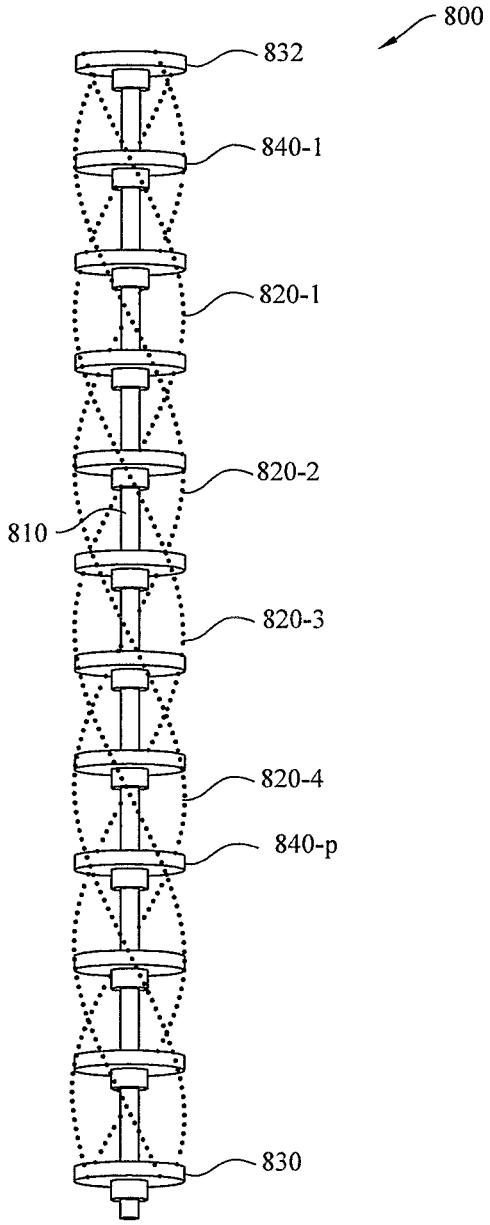
FIG. 8 depicts a second example of an adjustable helical antenna with the antenna having constraint disks.

FIG. 8 illustrates an adjustable quadrifilar helical antenna 800 with a linear central support 810. The antenna 800 has support disks 830, 832 with one or more constraint disks 840-1, **840-*p* positioned therebetween. The constraint disks 840 function as described with respect to the constraint disks 740. Antenna elements 820-1, 820-1, 820-3, and 820-4** can be coiled wire.

Figure 9:
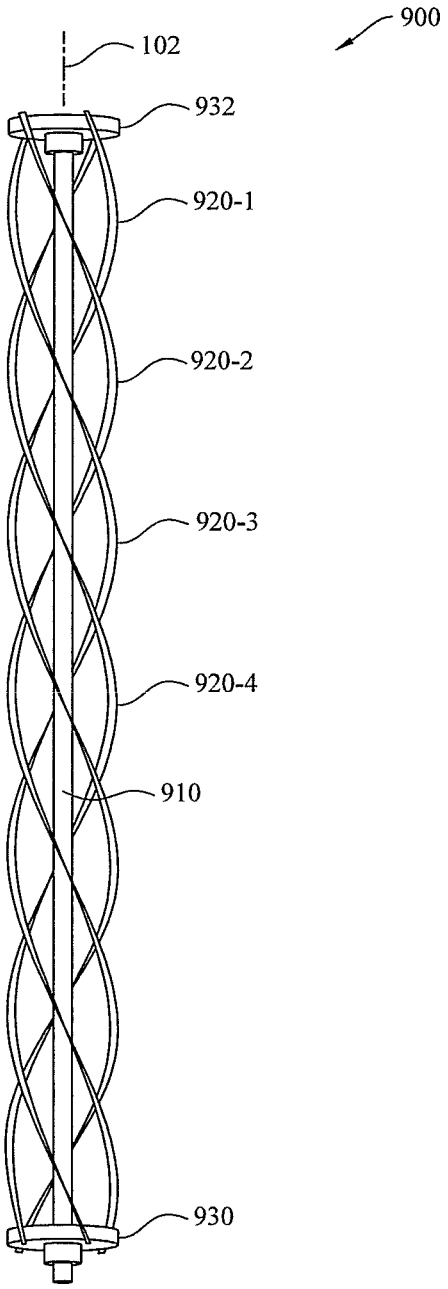
FIG. 9 depicts a first example of an adjustable helical antenna with the antenna having no constraint disks.

The following examples of adjustable helical antennas, which do not include constraint disks, bind the motion of the antenna elements at the top and bottom of the antenna, but not at intermediate positions along the antenna. FIG. 9 illustrates an adjustable quadrifilar helical antenna 900. The antenna 900 includes a linear central support 910 defining the helical axis 102.

The antenna 900 includes a plurality of antenna elements 920-1, 920-2, 920-3, and 920-4. Each respective antenna element 920-1, 920-2, 920-3, and 920-4 is fixed at a first point to the support disk 930 and fixed at a second point to the support disk 932.

For example, the antenna element 920-1 is fixed at or near one of the ends to the support disk 932. At the support disk 930, the antenna element 920-1 is fixed to the support disk and extends past the support disk, for example, to be coupled electrically to a signal generator.

Each of the respective antenna elements 920 defines a respective helical path around the linear central support 910 and between the support disks 930, 932. As shown, the antenna elements 920 are metal wires. Alternatively, the antenna elements can be metal ribbons. Although shown as a quadrifilar antenna, the antenna 900 may be a bifilar antenna having two antenna elements.

Figure 10:
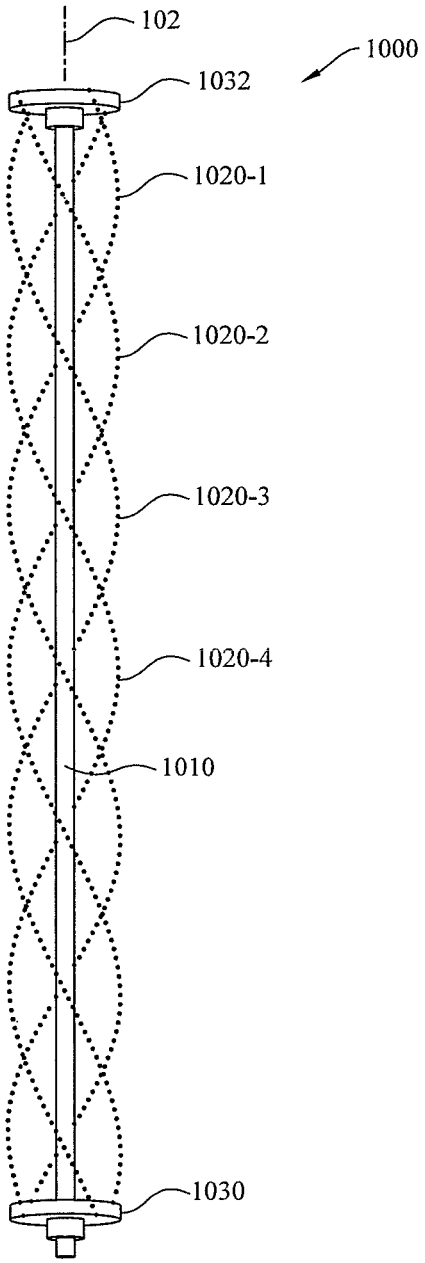
FIG. 10 depicts a second example of an adjustable helical antenna with the antenna having no constraint disks.

FIG. 10 illustrates an adjustable quadrifilar helical antenna 1000. The antenna 1000 includes support disks 1030 and 1032 as well as a linear central support 1010. The antenna elements 1020-1, 1020-2, 1020-3, and 1020-4 can be coiled wire.

Figure 11:
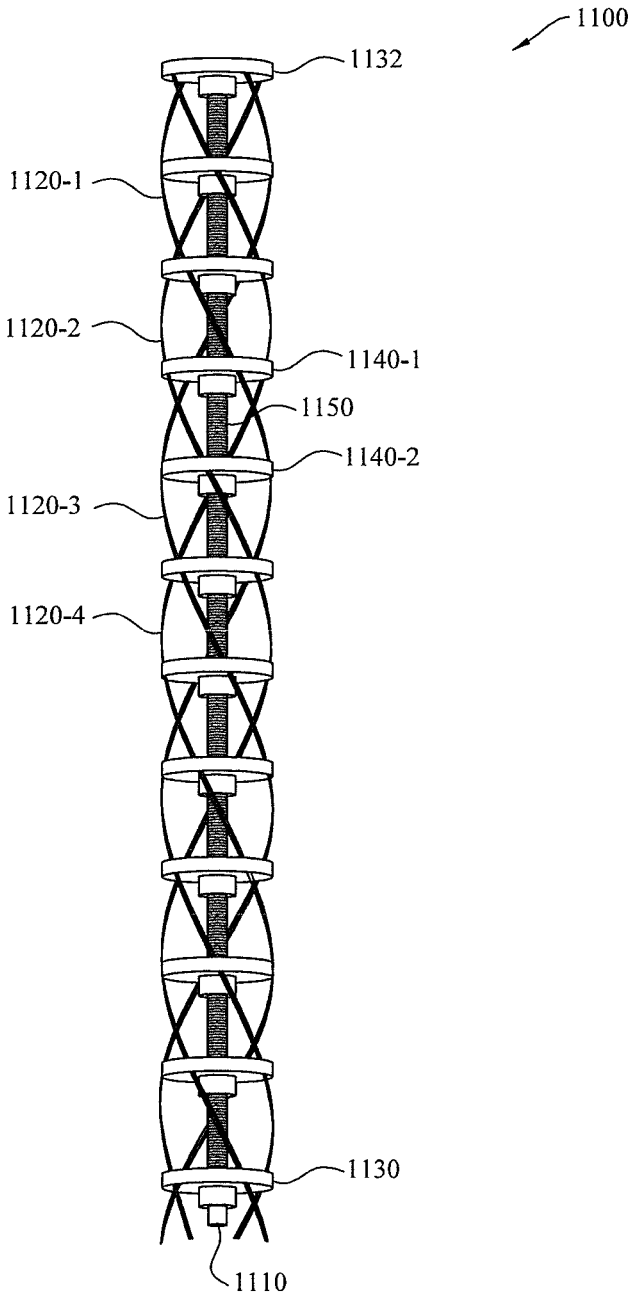
FIG. 11 depicts a third example of an adjustable helical antenna with the constraint disks connected by springs.

FIG. 11 illustrates an example of an adjustable helical antenna 1100. The antenna 1100 includes one or more antenna elements 1120-1, 1120-2, 1120-3, and 1120-4, and constraint disks 1140-1, and 1140-2. Additionally, the antenna 1100 includes elastic elements between each pair of adjacent constraint disks 1140-1, and 1140-2. The elastic elements can be made out of an electrically-insulated material such as rubber or plastic.

The elastic elements may be springs 1150, having one end coupled to one of the constraint disks 1140-1 and an opposing other end coupled to an adjacent constraint disk 1140-2. Each spring 1150 is slidably wrapped around the linear central support 1110 so that the spring can stretch and contract with minimal contact with the central support.

The springs 1150 are more compressed when support disks 1130 and 1132 are closer together, and more elongated when the support disks are farther apart. When the separation of the support disks 1130 and 1132 changes; the respective springs 1150 expand or contract independently to vary the motion of the constraint disks 1140 incrementally from the bottom of the antenna 1100 to the top; thereby, allowing rotation and translation of the constraint disks 1140 to equilibrate the elastic tension among the elastic elements.

When the antenna 1100 is set at a height, the support disks 1130 and 1132 are fixed at their respective positions with respect to the length of the linear central support 1110 so that the elastic tension does not pull one of the support disks towards the other. For example, the support disk 1130 can be tethered to a base with a detachable tether, or may be secured with a tensionable and removable clamp to the central support 1110.

Figure 12:
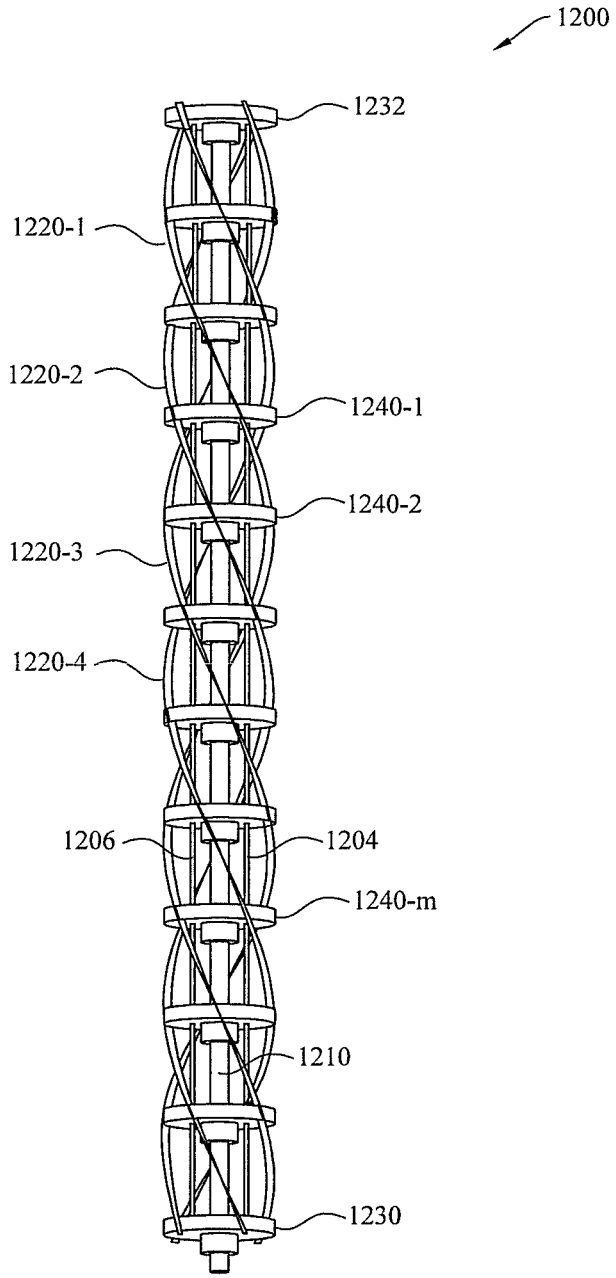
FIG. 12 depicts a third example of an adjustable helical antenna with the constraint disks connected by elastic elements.

FIG. 12 illustrates an adjustable helical antenna 1200. The antenna 1200 includes one or more antenna elements 1220-1, 1220-2, 1220-3, and 1220-4 as well as a plurality of constraint disks 1240-1, 1240-2 and **1240-*m*. The antenna 1200 includes elastic elements in the form of two or more elastic bands 1204 and 1206. Each of the respective elastic bands 1204, 1206** connects by an end to adjacent constraint disks radially outward from the linear central support and radially inward from the perimeter of the constraint disk.

The elastic bands 1204, 1206 are unstretched or slack when support disks 1230 and 1232 are at a minimum separation, and are more stretched and elastically tensioned when the support disks are farther apart. When the separation of the support disks 1230, 1232 changes; the elastic bands 1204, 1206 act to vary the motion of the constraint disks incrementally from the bottom of the antenna 1200 to the top of the antenna; thereby, allowing rotation and translation of the constraint disks to equilibrate the elastic tension among all of the bands.

When the antenna 1200 is set at a height; the support disks 1230 and 1232 can be fixed at their respective positions with respect to the length of a linear central support 1210 so that the tension of the elastic bands 1204, 1206 does not pull one of the support disks towards the other.

Figure 13:
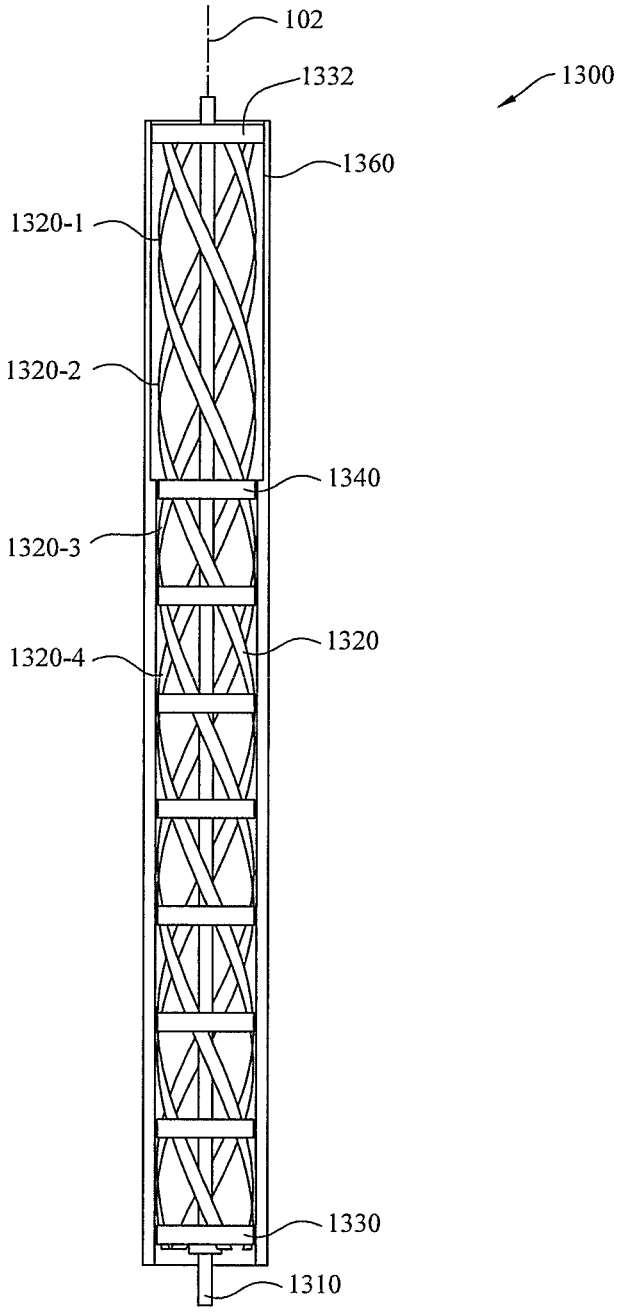
FIG. 13 depicts an example of an adjustable helical antenna with an external constraint.

FIG. 13 illustrates an adjustable helical antenna 1300 where the antenna elements are constrained externally with end disks 1330 and 1332. The antenna 1300 includes one or more antenna elements 1320-1, 1320-2, 1320-3, 1320-4. The antenna elements 1320-1, 1320-2, 1320-3, 1320-4 can be metal ribbons as shown, or may be wire or coiled wire. The antenna 1300 includes a housing 1360 to contain a linear central support 1310, the antenna element(s) and the constraint disks in a sliding arrangement with the housing.

The housing 1360 can be a hollow tube, a cylindrical sleeve, or otherwise define an interior space into which the linear central support, antenna elements, support disks, and constraint disks can be inserted, and within which these elements can translate along the helical axis 102. An internal radius of the housing is slightly larger than the helical radius to permit the sliding arrangement. The housing 1360 can be made of an electrically-insulating material such as acrylic tubing, rubber tubing, plastic, glass, ceramic, or wood.

In the antenna 1300, the antenna elements 1320 are not coupled to the constraint disks 1340. The constraint disks 1340 can have notches cut into their perimeters as shown, for example, in FIG. 2B. The antenna elements 1320 fit and slide within the notches when the pitch changes.

Figure 14:
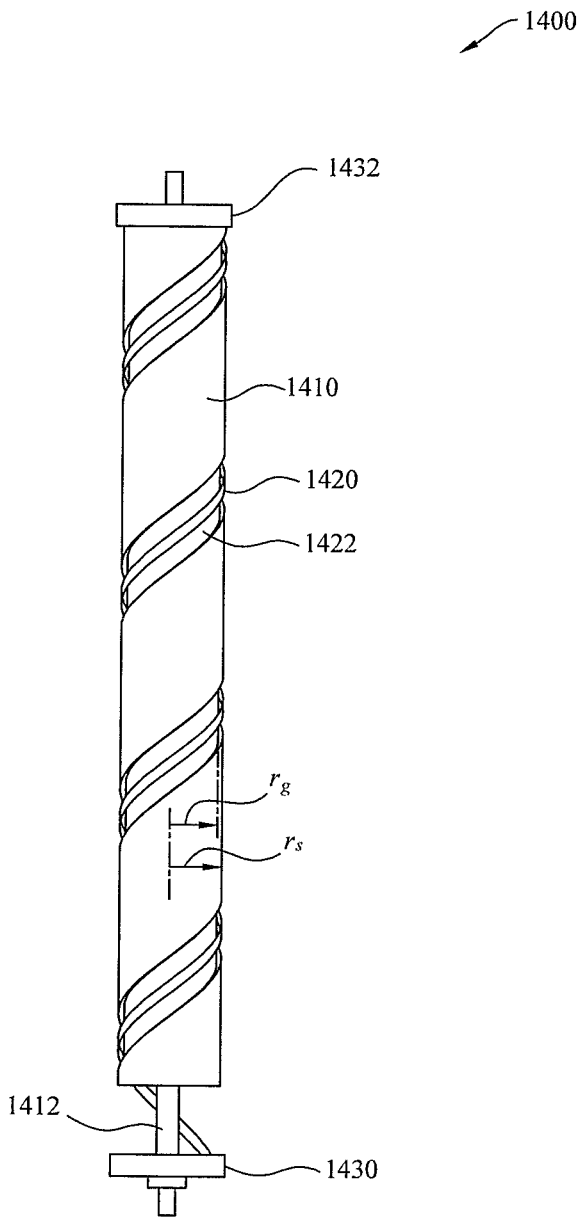
FIG. 14 depicts an example of an adjustable helical antenna with a constraint groove.

FIG. 14 illustrates an adjustable monofilar helical antenna 1400. The antenna 1400 has a linear central support 1410, an antenna element 1420, and support disks 1430, 1432. The radius $r_s$ of a part of the central support 1410 is slightly larger than the radius of the helix defined by the antenna element 1420. The antenna 1400 includes a narrower section

1412 of the central support 1410 to allow the support disk 1430 to translate along the height of the section 1412 when the pitch of the helix is adjusted.

The linear central support 1410 has a continuous helical groove 1422. The radius of the groove $r_g$ is the radius of the helix. The groove 1422 has a width sufficient to allow the angle of the antenna element 1420 to vary within the groove from the highest to the lowest pitch operating angles of the antenna 1400. The groove 1422 constrains the antenna element 1420 from collapsing radially inward. The antenna 1400 can be positioned inside a housing similar to the housing shown in FIG. 13 in order to constrain the antenna element 1420 from radial outward bowing.

It will be appreciated that the configurations disclosed herein are exemplary in nature, and that these embodiments are not to be considered as limiting because variations are possible. The present invention includes novel and non-obvious combinations and sub-combinations of the various systems and configurations, and other features, functions, and/or properties disclosed herein.

What is claimed is:

1. An adjustable antenna comprising:

a linear central support defining a helical axis;

a first support disk extending radially from said linear central support wherein said first support disk is capable of rotating around said linear central support;

a second support disk extending radially from said linear central support wherein said second support disk is capable of rotating around said linear central support and capable of translating along said linear central support;

an antenna element defining a length and coupled at a first point on the length to said first support disk, coupled at a second point on the length to said second support disk and defining a helical path having a pitch and a radius around said linear central support between said first support disk and said second support disk; and an adjustment component capable of translating said second support disk along said linear central support and capable of rotating said first support disk around said linear central support;

a base wherein said linear central support is capable of being adjusted between a first height and a second height relative to said base wherein the first height corresponds to a first separation distance between said first support disk and said second support disk, and the second height corresponds to a second separation distance between said first support disk and said second support disk; and at least one constraint disk defining a radius to constrain said antenna element in a radial direction at a location between said first and second support disks on said linear central support and capable of translating along said linear central support and capable of rotating around said linear central support.

2. The adjustable antenna of claim 1, further comprising a plurality of constraint disks, disposed between said first and second support disks.

3. The adjustable antenna of claim 2, further comprising a plurality of elastic elements with each of said plurality of elastic elements connected to two adjacent constraint disks of said plurality of constraint disks.

4. An adjustable antenna comprising:

a linear central support defining a helical axis;

a first support disk extending radially from said linear central support wherein said first support disk is capable of rotating around said linear central support;

a second support disk extending radially from said linear central support wherein said second support disk is capable of rotating around said linear central support and capable of translating along said linear central support;

an antenna element defining a length and coupled at a first point on the length to said first support disk, coupled at a second point on the length to said second support disk and defining a helical path having a pitch and a radius around said linear central support between said first support disk and said second support disk; and an adjustment component capable of translating said second support disk along said linear central support and capable of rotating said first support disk around said linear central support;

wherein said linear central support has a radius larger than the radius of the helix and has a helical groove to receive said antenna element, wherein a width of said helical groove is so configured to permit an angle of said antenna element to change within said groove when a pitch of the helical path changes.

5. An adjustable antenna system comprising:

a base having a transceiver;

an adjustable antenna coupled to said base and having:

a linear central support defining a helical axis;

a first support disk extending radially from said linear central support wherein said first support disk is capable of rotating around said linear central support;

a second support disk extending radially from said linear central support wherein said second support disk is capable of rotating around said linear central support and capable of translating along said linear central support;

an antenna element defining a length and electrically coupled to said transceiver, coupled at a first point on to said first support disk, coupled at a second point to said second support disk, and defining a helical path having a pitch and a radius around said linear central support between said first and second support disks; and an adjustment component configured to change a separation between said first and second support disks along the helical axis, wherein the pitch of the helical path at a first separation is smaller than the pitch of the helical path at a second and larger separation;

wherein said adjustable antenna further has a constraint disk to constrain said antenna element in a radial direction at a location between said first and second support disks on said linear central support and capable of translating on said linear central support along the helical axis and capable of rotating around the helical axis.

* * * * *